United States Patent [19]

Vrenken et al.

[11] 4,045,664

[45] Aug. 30, 1977

[54] LIGHTING FITTING PROVIDED WITH AT LEAST TWO-LOW-PRESSURE MERCURY VAPOR DISCHARGE LAMPS

[75] Inventors: Louis Eugéne Vrenken; Pieter Hendrik Broerse, both of Eindhoven, Netherlands

[73] Assignee: U.S. Philips Corporation, New York, N.Y.

[21] Appl. No.: 285,457

[22] Filed: Aug. 31, 1972

[30] Foreign Application Priority Data

Sept. 4, 1971 Netherlands ..... 7112208

[51] Int. Cl.[2] ..... F21V 11/18

[52] U.S. Cl. ..... 240/46.03; 240/46.17; 240/51.11 R; 315/294

[58] Field of Search ..... 240/46.03, 46.17, 46.49 R, 240/46.49 A, 51.11 R, 73 LD, 78 LD, 92, 106; 315/294, 296, 298, 312

[56] References Cited

U.S. PATENT DOCUMENTS

| | | | |
|---|---|---|---|
| 2,301,419 | 11/1942 | Lew | 240/92 X |
| 2,642,523 | 6/1953 | Wince | 240/73 LD |
| 2,798,942 | 7/1957 | Mason | 240/46.17 |
| 3,644,785 | 2/1972 | Jarmar | 315/298 |

*Primary Examiner*—Fred L. Braun

*Attorney, Agent, or Firm*—Frank R. Trifari; Robert S. Smith

[57] ABSTRACT

In a lighting fitting provided with at least two low-pressure mercury vapor discharge lamps whose radiated light has a different spectral composition. The lighting fitting is provided with apparatus to control the lumen ratio of the two lamps without varying the lumen level of the fitting. According to the invention low-pressure mercury vapor discharge lamps are used in the fitting which, inter alia as regards their color point, satisfy special requirements so that the color rendition obtained with these lamps is always of a high quality for each mixing ratio of the light from these lamps.

6 Claims, 4 Drawing Figures

LIGHTING FITTING PROVIDED WITH AT LEAST TWO-LOW-PRESSURE MERCURY VAPOR DISCHARGE LAMPS

The invention relates to a lighting fitting provided with at least two low-pressure mercury vapour discharge lamps having different colour points, which fitting is furthermore provided with means to continuously vary the ratio of the contributions of the two lamps to the lumen value in case of a substantially constant lumen value of the light radiated by the fitting.

The colour point of a lamp in understood to mean the point in the so-called colour triangle which is representative of the visible radiation from this lamp. As is known the location of such a point is indicated by co-ordinates (x- and y-co-ordinates).

A known fitting of the above-mentioned kind is described, for example, un U.S. Pat. No. 2,306,666. An advantage of this known fitting is that the spectral composition of the light to be radiated can be varied. A drawback of this known fitting is, however, that the lamp provided therein radiate an intensely coloured light so that the colour rendition of an object receiving light from this fitting is substantially always of a slight quality.

The invention has for its object to provide a lighting fitting in which both the spectral composition of the emitted light can be varied and the colour rendition of an object is always of high quality.

A colour rendition criterion employed hereinafter is the commonly used "colour rendition index Ra8", which is indicated by the C.I.E. (International Commission on Illumination) as: "General Colour Rendering Index" (see publication C.I.E. No. 13, E-1.3.2 1965, chapter 5). A better colour rendition yields a larger Ra8 number.

According to the invention a lighting fitting provided with at least two low-pressure mercury vapour discharge lamps having different colour points, which fitting is furthermore provided with means to continuously vary the ratio of the contributions of the two lamps to the lumen value in case of a substantially constant lumen value of the light radiated by the fitting, characterized in that the colour rendering index Ra8 of the two lamps is more than 80 and that the line of connection between the colour points of these two lamps in the colour triangle is located relative to the line of the black body such that the colour rendering index Ra8 of the light radiated by the fitting is more than 80 for each contribution ratio of the two lamps and that the colour temperatures of the two lamps are between 2500° and 7000° Kelvin.

The colour temperature of a lamp is understood to mean that temperature of the so-called black body in which a radiation is emitted in the visible range which has the same colour as that of the relevant lamp.

An advantage of a lighting fitting according to the invention is that without variation of the lumen level different nuances of white light can be radiated, which different nuances all lead to a satisfactory colour rendition of objects on which light from the fitting is incident. It is surprising that this is possible with a combination of two lamps only.

A fitting according to the invention might be used, for example, in a room or hall in which different festivities take place successively. A suitable white hue of the light can then be obtained with the relevant fitting for each of these events.

It is also feasible that the fitting according to the invention can be used, for example, in offices where daylight is to be supplemented by artificial light and where the fitting is adjusted at a cool (blue) white hue on hot days and a slightly red white hue on cold days.

It is known that the line of the black body in the colour triangle exhibits a relatively sharp curvature in case of decreasing temperatures below 2500° K. If a low-pressure mercury vapour discharge lamp having a colour temperature of less than 2500° K were used, the colour temperature of the other lamp could only be slightly higher because otherwise the connection line between the colour points of the two lamps would be too far away from the above-mentioned line of the black body (due to the said relatively sharp curvature of this line below 2500° Kelvin) which would lead to a low Ra8. In practice this range below a colour temperature of 2500° Kelvin is therefore not interesting. For colour temperatures of more than 7000° Kelvin the light generally acquires a colour which is too blue. All this has the result that in a fitting according to the invention lamps having a colour temperature of between 2500° and 7000° Kelvin are used.

In a fitting according to the invention one lamp preferably has a colour temperature of approximately 2700° Kelvin and the other lamp has a colour temperature of approximately 6500° Kelvin.

An advantage of this preferred embodiment is that there is a very wide range of white hues while furthermore conventional low-pressure mercury vapour discharge lamps can be used.

A fitting according to the invention is preferably provided with a spill shield.

An advantage thereof is that the light from the two lamps upon emerging from the fitting is better mixed so that the spectral composition of the light-incident on an object-is less dependent on the position of this object.

The means to vary the ratio of the contributions of the two lamps to the lumen value of the fitting may consist of, for example, louvres to be moved over a lamp respectively to be moved away from the second lamp.

The means to vary the contribution ratio of the two lamps preferably consist of at least one light-tight cylinder which can be displaced along the lamps.

An advantage of this embodiment is that the shielding of light from the unwanted lamp parts is more effective because a cylinder can embrace a lamp substantially throughout the lamp cross-section.

In a further preferred embodiment the means to vary the contribution ratio of the first and the second lamp consist of optical filters having a light transmission which varies continuously from one side to the other side of such a filter.

An advantage of this preferred embodiment is that for substantially all contribution ratios the total lighting surface of the two lamps contribute to the radiation of light from the fitting so that the risk of a strange variegation of bright and dark parts is small when looking at the fitting.

In a further preferred embodiment of a fitting according to the invention the means to vary the contribution ratio of the first and the second lamp include electrical circuit elements having two pairs of anti-parallel thyristors and associated drivers, one pair of anti-parallel thyristors being connected in series with the first lamp and the other pair of anti-parallel thyristors being connected in series with the second lamp, the driver circuits of the two thyristor pairs being coupled in such a manner that acceleration of the instance when the thyristors of one pair are rendered conducting causes a delay of the instants when the thyristors of the other pair are rendered conducting.

An advantage of the last-mentioned preferred embodiment is that no lamplight is to be shielded so that less heat is evolved in the fitting and hence the efficiency may be greater.

A further advantageous embodiment of a fitting according to the invention is equipped with a control member by which the lumen value of the fitting can be adjusted at different levels and by which the contribution ratio of the first and the second lamp can be varied at each of these levels.

An advantage of the above-mentioned embodiment is that both the white light hue and the lumen level can be adjusted by means of this fitting. For offices in which daylight is supplemented by artificial light a pleasant lighting, as regards the colour and, of sufficient level and satisfactory colour rendition can always be realized with such a fitting.

The invention will be further described with reference to the accompanying drawings. In the drawings.

Figure 1:
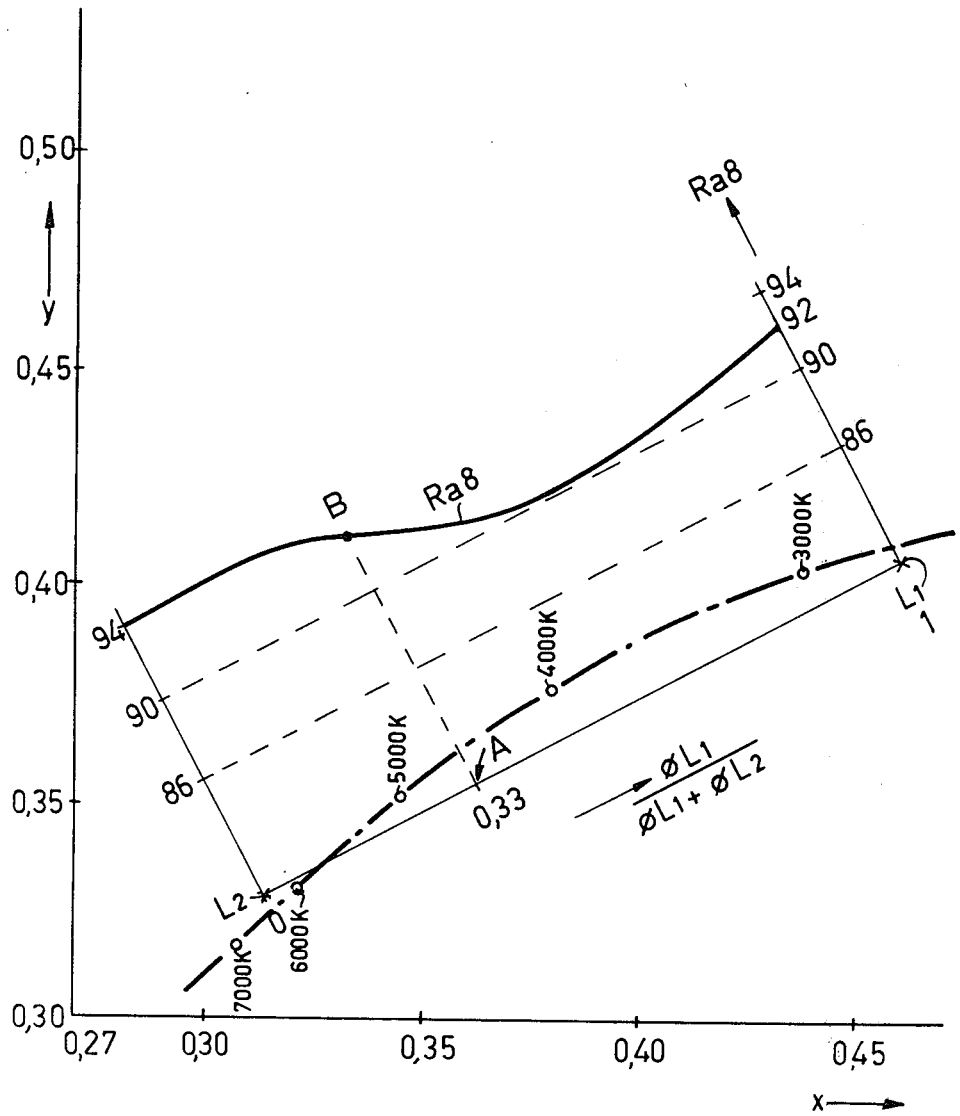
FIG. 1 shows part of the colour triangle including, inter alia, the line of the black body and the colour points of two light sources $L_1$ and $L_2$; and a graph in which the colour rendering index Ra8 is plotted against the ratio of the contribution ($\phi L_1$) of the light source $L_1$ and the total light production ($\phi L_1 + \phi_{L2}$) of the two light sources $L_1$ and $L_2$.

In FIG. 1 the axis denoted by $x$ represents the x-co-ordinate axis of the colour triangle. The y-co-ordinate axis of the colour triangle is denoted by $y$. Only a limited part has been shown of both the x-axis and the y-axis in FIG. 1.

In FIG. 1 a chain-link line represents the line of the so-called black body. The corresponding degrees of Kelvin have been indicated at different points on this line. The point L1 of FIG. 1 shows the colour point of a given low-pressure mercury vapour discharge lamp having a colour temperature of approximately 2700° Kelvin. In FIG. 1, L2 denotes the colour point of a second low-pressure mercury vapour discharge lamp. In this case a lamp having a colour temperature of approximately 6500° Kelvin is concerned. In FIG. 1, L1 and L2 are connected together by means of a straight line. Located on this line are the colour points of the various contribution ratios of $\phi L1/(\phi L1 + \phi L2)$. In addition the last-mentioned ratio is plotted along this line. This ratio represents the quotient of the amount of light originating from the lamp of colour point L1 and the total quantity of light originating from the lamp of colour point L1 plus that of the lamp of colour point L2. The Ra8, namely the colour rendering index is plotted at right angles to the line L1–L2 which index is obtained when lighting objects with either one lamp or the other lamp, or with light which partly originates from one lamp and for the rest originates from the other lamp. The Ra8 is thus plotted against $\phi L1/(\phi L1 + \phi L2)$. The colour rendering index of the lamp L1 is approximately 92 as is shown in FIG. 1. The colour rendering index of the light source L2 is approximately 94. The colour rendering indices of these two light sources are thus very satisfactory. It will be evident from the foregoing that each point on the connection line L1–L2 represents a given mixing ratio of the light from the two lamps. Point A on this line is representative of the situation at which the lumen quantity of the lamp L1 relative to the total lumen quantity of the lamps L1 and L2 have a ratio of 1:3. The distance between 0 and A is therefore half the distance between A and 1. The colour rendering index which corresponds to the situation A is denoted by point B on the Ra8 curve. Thus a colour rendering index of approximately 93 is concerned in this case.

FIG. 1 serves to illustrate with reference to the following Figures the embodiments of fittings to be described which are based on the use of the light sources having colour points L1 and L2 and in which arbitrary mixing ratios between the lumen values of these two light sources are realized.

FIG. 1 shows that in the given case for the two light sources L1 and L2 the colour rendering index Ra8 always has a value of approximately 90 or more.

Figure 2:
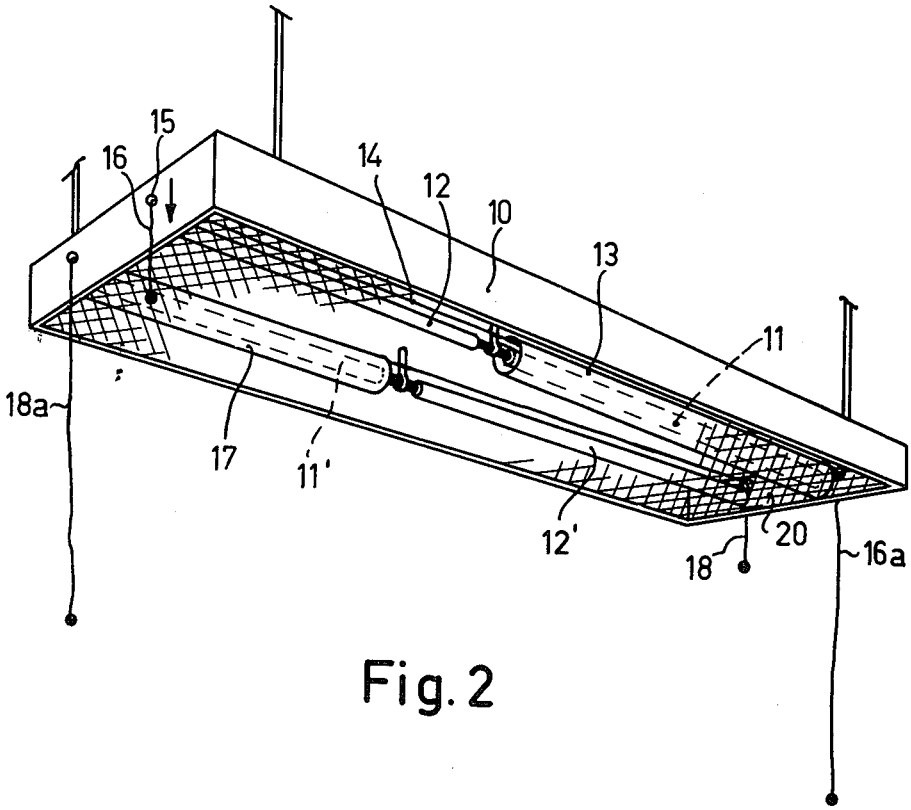
FIG. 2 is a perspective diagrammatical view of a first embodiment of a lighting fitting according to the invention.

In FIG. 2, 10 denotes a rectangular housing for a lighting fitting. Two rows of lamps are mounted in housing 10. The first row comprises the low-pressure mercury vapour discharge lamps 11 and 12. The second row comprises the low-pressure mercury vapour discharge lamps 11' and 12'.

Lamp 11 is surrounded by a substantially light-tight cylinder whose length approximately corresponds to the length of lamp 11. Lamp 11 is of the type which is indicated by L1 in FIG. 1. Thus it is a lamp having a colour temperature of approximately 2700° Kelvin.

Lamp 12 of FIG. 2 is a lamp as is indicated by L2 in FIG. 1. Thus it is a lamp having a colour temperature of approximately 6500° Kelvin.

In further describing FIG. 2 the light sources 11' and 12' will be omitted in the first instance, because they can be provisionally left out of consideration for a satisfactory understanding of the operation of this fitting.

Cylinder 13 can be displaced with the aid of a cord 14 which protrudes through a hole 15 in housing 10 and which is denoted outside the housing by 16. When pulling the cord 16 in the direction of the arrow, the cylinder will move in the direction of hole 15. This means that the cylinder will then cover a portion of the surface of the lamp 12 and simultaneously uncovers an equally large portion of the lamp 11. Cord 16*a* serves to displace cylinder 13 in the opposite direction.

The situation as shown in row 11, 12 (in FIG. 2) actually corresponds to the colour point denoted by L2 in FIG. 1. When the cylinder 13 is moved to lamp 12, one moves in fact on the connection line between L2 and L1 (see FIG. 1) and when cylinder 13 entirely surrounds lamp 12 the situation is obtained which is indicated by colour point L1 in FIG. 1. Thus a fitting can be made with one row 11, 12 and cylinder 13 with which the colour hue can be varied while maintaining the light level. It is to be noted that the surface brightness and the dimensions of the two lamps 11 and 12 were adjusted at the same values.

The second row of discharge lamps 11' and 12' in FIG. 2 is substantially equal to that of the first row. This means that the lamp 11 and 11' are of the same type and that the lamps 12 and 12' are likewise of the same type. A light-tight cylinder which can be compared with cylinder 13 is denoted by 17. The double construction, i.e. the two rows as shown in FIG. 2 is only used because in this fitting an even better mixture of the light of the two kinds of lamps can be obtained. It is not necessary to operate the two cylinders 13 and 17 simultaneously, but this is not objectionable.

Cords 18 and 18*a* are provided for operating the cylinder 17.

A spill shield is denoted by 20.

Figure 3:
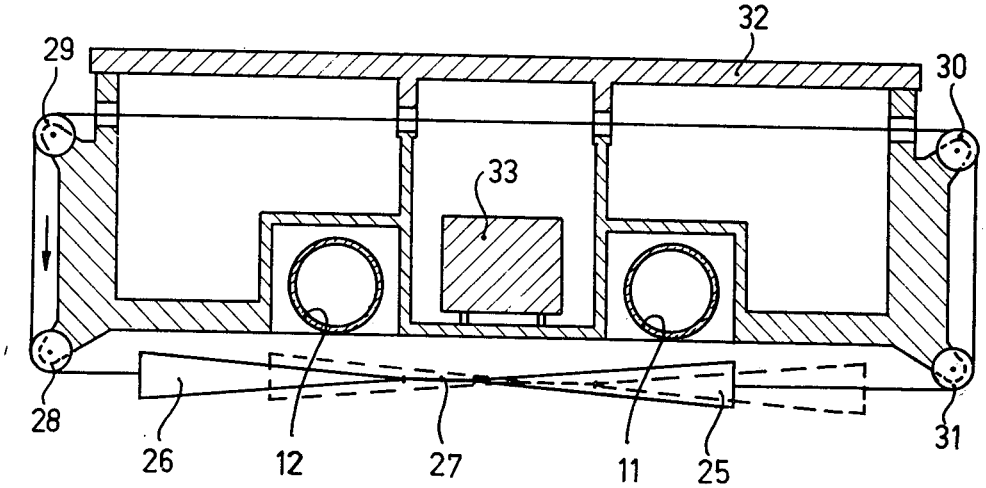
FIG. 3 is a diagrammatical view of a cross-section of a second embodiment of a lighting fitting according to the invention.

FIG. 3 shows a lighting fitting according to the invention which is provided with a lamp 11 and a lamp 12. Lamp 11 is a lamp which corresponds to L1 of FIG. 1 and lamp 12 is a lamp which corresponds to L2 of FIG. 1.

A different mixing ratio of the light of the lamps 11 and 12 is realized in the fitting of FIG. 3 with the aid of optical filters having a varying light transmission . To this end a wedge-like filter 25 is located in front of the light source 11. A likewise wedge-like filter 26 is located in front of lamp 12. Filters 25 and 26 are neutral filters. The light transmission is determined by the thickness. The two filters 25 and 26 are connected by means of a cord 27. The combination 25, 27, 26 forms part of an endless belt which is passed over four guide rollers 28, 29, 30 and 31. A top plate of the fitting is denoted by 32. This top plate may be mounted, for example, against the ceiling of a room. A ballast for stabilising the discharge in the lamps 11 and 12 is denoted by 33. In the position shown of filters 25 and 26 the light from light source 11 is strongly shaded, while the light from light source 12 only needs to pass a thin portion of filter 26 and is thus very little shaded. Thus this is a situation which corresponds to a point on the connection line L2–L1 (see FIG. 1) which is located closely to L2.

When pulling the cord between rollers 29 and 28 in the direction of the arrow, the filters will ultimately occupy the other extreme position which is shown by broken lines in FIG. 3. In that case the light from light source 11 is hardly shaded, but the light which originates from light source 12 is strongly shaded because it must now pass a thick portion of filter 26. Consequently a mixing ratio which is represented in FIG. 1 by a point located very closely to L1 is obtained. For intermediate positions between the two extreme positions shown in FIG. 3 of filters 25 and 26 mixing ratios can be realized which are located elsewhere on the connection line between L1 and L2 in FIG. 1.

The situations as shown in the above described FIGS. 2 and 3 denote mechanical means to achieve the different mixing ratios of the light from the two lamps. An electrical circuit diagram will be described in FIG. 4 in which the mixing ratio of the two light sources is electrically controlled.

Figure 4:
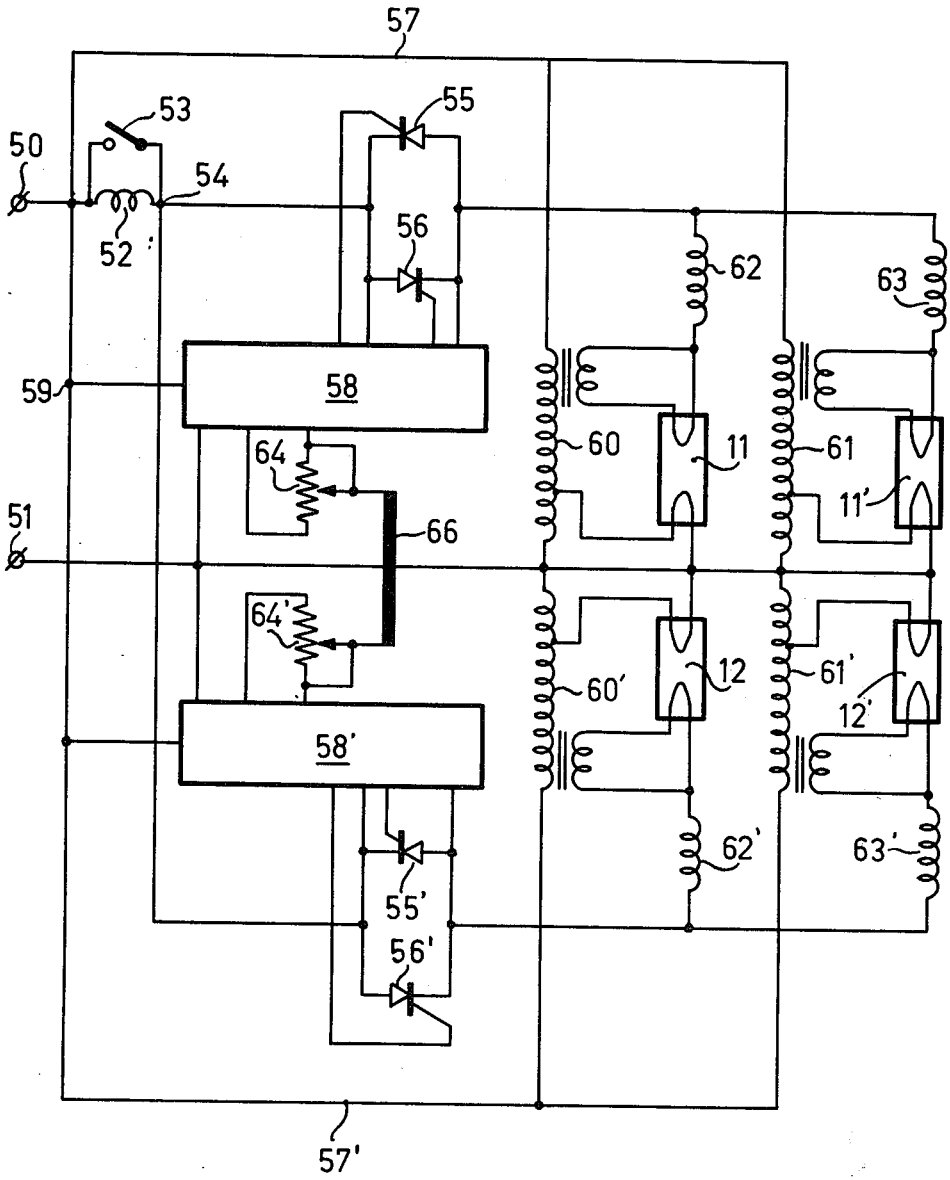
FIG. 4 is an electrical principle circuit diagram for the electrical supply and electrical control of a modification of the lighting fitting according to FIG. 2.

The electrical circuit diagram shown in FIG. 4 may be used for supplying lamps in a fitting which is a modification of the fitting shown in FIG. 2. The two cylinders 13 and 17 (from FIG. 2) are considered to be removed. The lamp 11 shown in FIG. 4 is the same as the lamp denoted by 11 in FIG. 2. This likewise applies to the lamps 11' and to the lamps 12 and 12'. As already previously noted, the lamps 11 and 11' are of one given lamp type which is denoted by L1 in FIG. 1. Furthermore lamps 12 and 12' are of a different lamp type which is denoted by the colour point L2 in FIG. 1.

In FIG. 4 input terminals of the arrangement are denoted by 50 and 51. Terminal 50 is connected to an auxiliary inductor 52 which is shunted by a switch 53. The other side of the inductor 52 is denoted by 54. Point 54 is connected to a combination of two anti-parallel arranged thyristors 55 and 56 and in addition to a second combination of two anti-parallel arranged thyristors (55' and 56'). Furthermore the input terminal 50 is connected to a wire 57. In addition terminal 50 is connected to a driver 58 for thyristors 55 and 56 through a tap 59. The conductor 57' likewise connected to tap 59 leads to an identical part of the circuit. The longitudinal conductor which is connected to the terminal 51 actually constitutes the separation between the two substantially identical parts of the circuit.

Wire 57 is connected to the primary windings of two filament current transformers 60 and 61. The other sides of these primary windings are connected to the input terminal 51 of the arrangement. Ballast inpedances 62 and 63 are connected to the sides of thyristors 55 and 56, respectively, remote from mains terminal 50. The low-pressure mercury vapour discharge lamp 11 is connected in series with the impedance 62. The low-pressure mercury vapour discharge lamp 11' is connected in series with the impedance 63. The other sides of these lamps 11 and 11' are connected to the input terminal 51 of the mains.

The driver 58 mentioned above is formed, for example, as shown in FIG. 1 of the Netherlands Patent Application No. 6,402,538. The variable resistor 64 also belongs to the driver 58. This resistor corresponds to the variable resistor in the driver circuit of the diagram in the afore-mentioned Netherlands Patent Application. A variations of the position of the wiper on the variable resistor 64 changes the instant of triggering the thyristors 55 and 56 relative to the commencement of the half cycle of the supplying alternating voltage across the terminals 50 and 51.

As already noted, the part of the circuit located below the longitudinal conductor which is connected to the mains terminal 51 is substantially identical to the circuit located above said conductor. Corresponding parts of the circuit have the same reference numerals in the lower part but with the addition with indices. An exception has been made for the lamps only.

The variable resistors 64 and 64' are mechanically coupled in an opposite sense. This means that when one resistive value is increased, the other resistive value is automatically decreased. Resistors 64 and 64' are formed in such a manner that for each position of the coupling part 66 the combined total lumen values of the four lamps 11, 11', 12, 12' is always substantially the same (deviation ± 10%).

In combination with the fitting of FIG. 2 (excluding the cylinders 13 and 17) the use of the circuit of FIG. 4 led to a very suitable fitting in which the white hue could be adjusted in a very simple manner. In addition the efficiency was high because no unnecessary heat was evolved in the fitting. The short-circuit switch shown in FIG. 4 across the impedance 52 serves to vary the total level at which the lamps operate.

It will be evident that the curve shown in FIG. 1 for Ra8 can be obtained when using the different embodiments shown in the other Figure.

The fittings according to the invention, particularly those employing the circuit of FIG. 4 are very suitable for realising an adapted white colour of the light in a simple manner in those cases where a satisfactory colour rendition is always necessary.

What is claimed is:

1. An arrangement for providing illumination of selectable color value comprising:

a lighting fitting;

two low-pressure mercury vapor discharge lamps disposed within said fitting and having different color points, the color temperatures of the lamps being between 2500° and 7000° Kelvin, said lamps also having a color rendering index Ra8 of more than 80 and having a functional relationship wherein the line of connection between the color points of the two lamps in the color triangle located relative to the line of the black body is such that the color rendering index Ra8 of the combined light of the lamps radiating from the arrangement is more than 80;

and control means for adjusting the ratio of the light contributions of the two lamps to maintain an approximately constant lumen value of light radiated by said arrangement while modifying the spectral composition of the combined light of the lamps.

2. A lighting arrangement as claimed in claim 1, wherein one lamp in the fitting has a colour temperature of approximately 2700° K and the other lamp in the fitting has a colour temperature of approximately 6500° K.

3. A lighting arrangement as claimed in claim 1 wherein the fitting has a spill shield.

4. An arrangement for providing illumination of selectable color value comprising:

a lighting fitting;

two cylindrical low-pressure mercury vapor discharge lamps colinearly disposed within said fitting having different color points, the color temperatures of the lamps being between 2500° and 7000° Kelvin, said lamps also having a color rendering index Ra8 of more than 80 and having a functional relationship wherein the line of connection between the color points of the two lamps in the color triangle located relative to the line of the black body is such that the color rendering index Ra8 of the combined light of the lamps radiating from the arrangement is more than 80;

a light-tight cylindrical container of a longitudinal dimension approximately equal to one of the lamps;

and means to selectively displace said container along the axis of lamps to adjust the ratio of the light contributions of the two lamps, the lumen value of the light radiated by said arrangement remaining approximately constant as the spectral composition is modified by displacement of the container.

5. An arrangement for providing illumination of selectable color value comprising:

a lighting fitting;

two low-pressure mercury discharge lamps being disposed substantially parallel within said fitting and having different color points, the color temperatures of the lamps being between 2500° and 7000° Kelvin, said lamps also having a color rendering index Ra8 of more than 80 and having a functional relationship wherein the line of connection between the color points of the two lamps in the color triangle located relative to the line of the black body is such that the color rendering index Ra8 of the combined light of the lamps radiating from the arrangement is more than 80;

an optical filter being disposed beneath the lamps and supported by the fitting, said filter including portions having light transmissions which vary from either filter end toward the filter center;

and means for moving the filter in a direction transverse to the lamps for adjusting the ratio of the light contributions of the two lamps so as to maintain an approximately constant lumen value of light radiated while modifying the spectral composition of the combined light of the lamps as the filter is moved.

6. An arrangement for providing illumination of selectable color value comprising;

a lighting fitting;

two low-pressure mercury vapor discharge lamps disposed within said fitting and having different color points, the color temperatures of the lamps being between 2500° and 7000° Kelvin, said lamps also having a color rendering index Ra8 of more than 80 and having a functional relationship wherein the line of connection between the color points of the two lamps in the color triangle located relative to the line of the black body is such that the color rendering index Ra8 of the combined light of the lamps radiating from the arrangment is more than 80;

a first pair of thyristors connected in anti-parallel arrangement, said pair of thyristors being connected in series with said first lamp;

a second pair of thyristors connected in anti-parallel arrangement, said second pair being connected in series with said second lamp;

driver means for controlling the conduction of the two pairs of thyristors, said driver means being arranged to advance the conduction of one pair of thyristors while delaying the conduction of the other pair for adjusting the ratio of the light contributions of the two lamps to maintain an approximately constant lumen value of light radiated by said arrangement while modifying the spectral composition of the combined lamps.

* * * * *

UNITED STATES PATENT OFFICE

CERTIFICATE OF CORRECTION

Patent No. 4045664 Dated August 30, 1977

Inventor(s) Louis Eugene Vrenken et al

It is certified that error appears in the above-identified patent and that said Letters Patent are hereby corrected as shown below:

Column 3, line 2, "instance" should be --instants--;

line 31, "$(\emptyset L_1 + \emptyset_{L2})$" should be $--(\emptyset L_1 + \emptyset L_2)--$.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*